US005740132A

United States Patent [19]

Ohshima et al.

[11] Patent Number: 5,740,132

[45] Date of Patent: Apr. 14, 1998

[54] ELECTRONIC TIMEPIECE AND METHOD OF CHARGING THE SAME

[75] Inventors: Yasuhiro Ohshima; Joji Kitahara, both of Suwa, Japan

[73] Assignee: Seiko Epson Corporation, Tokyo, Japan

[21] Appl. No.: 439,527

[22] Filed: May 11, 1995

[30] Foreign Application Priority Data

May 13, 1994 [JP] Japan ..... 6-124144

[51] Int. Cl.[6] ..... G04B 1/00

[52] U.S. Cl. ..... 368/204; 368/203; 368/205

[58] Field of Search ..... 368/201–205

[56] References Cited

U.S. PATENT DOCUMENTS

| | | | |
|---|---|---|---|
| 4,041,691 | 8/1977 | Chihara et al. | 368/66 |
| 4,321,541 | 3/1982 | Nishizuka . | |
| 4,730,287 | 3/1988 | Yoshino et al. | 368/205 |
| 4,785,436 | 11/1988 | Sase . | |

FOREIGN PATENT DOCUMENTS

| | | |
|---|---|---|
| 40 41 696 C1 | 3/1992 | Germany . |
| 61-209372 | 2/1987 | Japan . |
| 5-80165 | 4/1993 | Japan . |
| 6-308206 | 11/1994 | Japan . |

*Primary Examiner*—Bernard Roskoski

*Attorney, Agent, or Firm*—Stroock & Stroock & Lavan LLP

[57] ABSTRACT

An electronic time piece senses and warns the electric residue of a secondary cell having electrodes of conductive polymer to a user during the rapid charge.

The electronic time piece converts a kinetic energy produced by the user's motion into an electric energy. The electric energy is then outputted from a power generator coil as a charging voltage for charging a chemical reaction type secondary cell. The charged energy in the secondary cell is used to actuate a time piece circuit for indicating the time.

The electronic time piece comprises an electric residue sensor unit which outputs an electric residue detection signal when the voltage in the secondary cell continues to exceed a reference voltage corresponding to an electric residue in the secondary cell for a predetermined time during the rapid charge.

5 Claims, 8 Drawing Sheets ta: SW off tb: SW on

ELECTRONIC TIMEPIECE AND METHOD OF CHARGING THE SAME

BACKGROUND OF THE INVENTION

1. Field of the Invention

The present invention relates to an electronic timepiece including a power generation mechanism and a method of charging such an electronic timepiece.

2. Description of the Prior Art

In the conventional electronic timepieces, the electric power for driving the electronic timepiece is supplied from a battery. However, the battery must be replaced by new one after it has been consumed.

Thus, an electronic timepiece including a power generation mechanism for generating an electric energy required to drive the electronic timepiece has been developed. Such a type of electronic timepieces include an electronic timepiece having a solar cell for charging its secondary cell, an electronic timepiece having an automated power generation mechanism actuated by the natural motion of a user's arm or other part to generate an output for charging the secondary cell, and so on. From viewpoints of resource saving and environment protection, attention has been attracted to these electronic timepieces since it does not require a troublesome exchange of the used cell for new one and also not produce any waste matter such as used cell and others.

Usually, such a type of electronic timepieces include a mechanism for sensing and indicating the remaining electrical quantity (electric residue) of the secondary cell. If the electric residue of the secondary cell is for about three hours, one day, two days, three days or other days, it can be sensed and indicated for prompting the user to charge the secondary cell.

Particularly, if the electric residue of the secondary cell is very low, e.g., equal to or less than three hours, the user must rapidly charge the secondary cell. For example, the electronic timepiece using the solar charging mechanism may be oriented to a light source for generating the power charging the secondary cell. In the other electronic timepiece having the automated power generation mechanism, the user may shake the electronic timepiece to charge the secondary cell. Such rapid charges will be carried out until the electric residue of the secondary cell reaches a predetermined level. To make such charges in a reliable manner, the electric residue of the secondary cell must be reliably sensed.

Usually, the electric residue of the secondary cell is detected by using its voltage of the secondary cell For example, if the secondary cell is formed of a capacitor or the like, the voltage of the secondary cell accurately reflects the charge of the secondary cell. The electric residue of the secondary cell can be sensed merely by detecting the voltage of the secondary cell.

More recently, the secondary cell of the electronic timepiece has been in the form of a secondary cell using electrodes of conductive polymer. Unlike the conventional chemical cells, the polymer cell has a property that the voltage of the secondary cell fluctuates until it reaches a stable level corresponding to the charge. This is because the polymer cell performs the charge and discharge through doping of the electrolyte ions. When the electric residue of the secondary cell is simply to be detected through the voltage of the secondary cell during the rapid charge, it could not accurately be sensed.

Particularly, such a type of secondary cell has a property that the voltage of the secondary cell sharply increases during the rapid charge and thereafter settles down at a stable level corresponding to the true charge. If the sensed voltage is simply compared with a reference level to sense the electric residue of the secondary cell, the electric residue thus sensed will indicate a level higher than the actual level. In many cases, therefore, the user will undesirably stop the rapid charge when the secondary cell is not sufficiently charged. In such cases, the electronic timepiece may unintentionally stop.

SUMMARY OF THE INVENTION

It is therefore an object of the present invention to provide an electronic timepiece which can reliably sense the electric residue of a secondary cell having electrodes of conductive polymer during the rapid charge and warn it to the user and a method of sensing the electric residue of the secondary cell.

To this end, the present invention provides an electronic timepiece comprising:

power generation means for outputting an electric charging energy;

a secondary power supply chargeable by the electric charging energy;

a timepiece circuit actuatable by a charged energy of the secondary power supply;

voltage sensor means for sensing a voltage of the secondary power supply;

electric residue sensor means responsive to the sensed voltage of the secondary power supply for sensing an electric residue of the secondary power supply; and electric residue warning means for warning the electric residue to a user for urging a charge of the secondary power supply to the user, the secondary power supply including a secondary cell with electrodes of conductive polymer, the electric residue sensor means being operative to output an electric residue detection signal corresponding to a reference voltage preset for an electric residue in the secondary cell when the sensed voltage continues to exceed the reference voltage for a predetermined reference time.

It is preferred that the electric residue sensor means is adapted to output a residue detection signal corresponding to one of reference voltages preset for various levels of electric residue in the secondary cell when the sensed voltage continues to exceed the one of reference voltages for a predetermined reference time.

The electric residue sensor means is preferably defined to set the reference time for each reference voltage.

The secondary cell may be any suitable one of polyacene cell, Li/PAS cell, PAS-Li composite/PAS cell and PAS/PAS cell.

The present invention also provides a method of sensing the electric residue of a secondary cell having electrodes of conductive polymer when the secondary cell is being rapidly charged by charging means, the method comprising:

first step of sensing the voltage of the secondary cell; and second step of sensing an electric residue of the secondary cell as an electric residue corresponding to a preset reference voltage, when a sensed voltage of the secondary cell continues to exceed the reference voltage for a predetermined reference time.

It is preferable that the second step involves sensing an electric residue of the secondary cell as an electric residue corresponding to one of a plurality of preset reference voltages, when a sensed voltage of the secondary cell continues to exceed the one of a plurality of reference voltages for a predetermined reference time.

In the electronic timepiece of the present invention, the secondary cell is charged with the electric charging energy outputted from the power generation means. The timepiece circuit is energized by the charged energy of the secondary cell.

The electric residue sensor means is responsive to the voltage of the secondary cell for sensing and warning the electric residue of the secondary cell to the user.

When the sensed residue becomes low, the user performs the rapid charge to the secondary cell until the electric residue thereof returns to a predetermined level.

If the secondary cell includes electrodes of conductive polymer, the voltage of the secondary cell fluctuates during the rapid charge and needs some time before it reaches a stable voltage corresponding to the charged energy.

In the present invention, a reference voltage corresponding to a residue of the secondary cell is preset. Only when the sensed voltage continues to exceed the reference voltage for a predetermined time, it is judged that the secondary cell has been charged to a level corresponding to at least the reference voltage. Based on such a judgment, an electric residue detection signal will be outputted. Thus, the user can accurately be informed of the electric residue of the secondary cell during the rapid charge.

It is preferable that the electric residue sensor means outputs an electric residue detection signal corresponding to one of a plurality of electric residue levels corresponding to one of reference voltages preset for various levels of electric residue in the secondary cell when the sensed voltage continues to exceed the one of reference voltages for a predetermined reference time.

In such an arrangement, the electric residue sensor means can output an electric residue detection signal corresponding to one of reference voltages preset for various levels of electric residue in the secondary cell, for example, three hours, one day or two days when the sensed voltage continues to exceed the one of reference voltages for a predetermined reference time. Thus, during the rapid charge, the charged levels of the secondary cell can be accurately indicated step by step.

The electric residue sensor means may be defined to set the reference time for every reference voltage. This enables the electric residue of the secondary cell to be more accurately sensed.

Particularly, the efficiency of charge in the polymer cell degrades as the voltage of the secondary cell becomes higher. Therefore, it is preferred that the reference time is prolonged for higher voltage.

The present invention further provides an electronic timepiece comprising:

power generation means for outputting an electric charging energy;

a secondary power supply chargeable by the electric charging energy;

a timepiece circuit actuatable by a charged energy of the secondary power supply;

voltage sensor means for sensing a voltage of the secondary power supply;

electric residue sensor means responsive to the sensed voltage of the secondary power supply for sensing an electric residue of the secondary power supply;

electric residue warning means for warning the electric residue to a user for urging the charge of the secondary power supply to the user; and charge cut-out switch means for cutting-out the charge to the secondary power supply from the power generation means, the secondary power supply including a secondary cell having electrodes of conductive polymer, the electric residue sensor means being responsive to attenuation characteristics of the sensed voltage when the charge to the secondary cell is temporarily cut out by the charge cut-out switch means for sensing the electric residue of the secondary cell to output an electric residue detection signal.

It is preferred that the electric residue sensor means estimates and computes the stable voltage of the secondary cell corresponding to the charged level from both the sensed voltage and attenuation characteristics of the secondary power supply and outputs an electric residue detection signal corresponding to a reference voltage preset for the electric residue of the secondary cell when the estimated and computed voltage exceeds the reference voltage.

It is also preferred that the electric residue sensor means outputs an electric residue detection signal corresponding to one of a plurality of reference voltages preset for various levels of electric residue in the secondary cell when the estimated and computed voltage exceeds the one of reference voltages.

The secondary cell may be any suitable one of polyacene cell, Li/PAS cell, PAS-Li composite/PAS cell and PAS/PAS cell.

The present invention further provides a method of sensing the electric residue of a secondary cell having electrodes of conductive polymer when the secondary cell is being rapidly charged by charging means, the method comprising:

first step of sensing the voltage of the secondary cell; and second step of temporarily stopping the charge to the secondary cell when the electric residue of the secondary cell is measured and then sensing the electric residue of the secondary cell from attenuation characteristics of the sensed voltage.

It is preferred that the second step involves estimating and computing a stable voltage of the secondary cell corresponding to an electric residue from both a sensed voltage and attenuation characteristics of the secondary cell and sensing the electric residue of the secondary cell as an electric residue corresponding to a preset reference voltage when the estimated and computed voltage exceeds the reference voltage.

It is further preferred that the second step involves sensing a level of electric residue corresponding to one of a plurality of reference voltages preset for various levels of electric residue in the secondary cell, as a level of electric residue in the secondary cell, when the estimated and computed voltage exceeds the one of reference voltages.

As described, the present invention comprises the charge cut-out switch means for temporarily stopping the charge to the secondary power supply from the power generation means during the rapid charge. At this time, the electric residue of the secondary cell is sensed based on attenuation characteristics of the sensed voltage.

The present invention further provides an electronic timepiece comprising:

power generation means for outputting an electric charging energy;

a secondary power supply chargeable by the electric charging energy;

a timepiece circuit actuatable by a charged energy of the secondary power supply;

electric residue sensor means for sensing the electric residue of the secondary power supply;

electric residue warning means for warning the electric residue to a user for urging the charge of the secondary power supply to the user; and current sensor means for sensing a charging current from the power generation means to the secondary power supply, the secondary power supply including a secondary cell having electrodes of conductive polymer, the electric residue sensor means being operative to compute the charged energy in the secondary cell from the charging current and a charging time and to sense the electric residue in the secondary cell from the charged energy for outputting an electric residue detection signal.

It is preferred that the electronic timepiece of the present invention also comprises voltage sensor means for sensing the voltage of the secondary power supply and that the electric residue sensor means is operative to correct and compute the sensed voltage from the charged energy and to output an electric residue detection signal corresponding to a reference voltage preset for a level of electric residue in the secondary cell when the corrected and computed voltage exceeds the reference voltage.

It is further preferred that the electric residue sensor means is operative to output an electric residue detection signal corresponding to one of a plurality of reference voltages preset for various levels of electric residue in the secondary cell when the corrected and computed voltage exceeds the one of reference voltages.

The secondary cell may be any suitable one of polyacene cell, Li/PAS cell, PAS-Li composite/PAS cell and PAS/PAS cell.

The present invention further provides a method of sensing the electric residue of a secondary cell having electrodes of conductive polymer when the secondary cell is being rapidly charged by charging means, the method comprising:

first step of sensing a charging current from a power generating means to the secondary cell; and second step of computing a charged energy to the secondary cell from the charging current and a charging time, and sensing the electric residue of the secondary cell based on the charged energy.

It is preferred that the first step involves sensing a voltage of the secondary power supply and wherein the second step involves correcting and computing the sensed voltage from the charged energy and sensing an electric residue of the secondary cell corresponding to a reference voltage preset for a level of electric residue in the secondary cell when the corrected and computed voltage exceeds the reference voltage.

It is further preferred that the second step involves sensing an electric residue of the secondary cell corresponding to one of a plurality of reference voltages preset for various levels of electric residue in the secondary cell when the corrected and computed voltage exceeds the one of reference voltages.

According to the present invention, the charged energy in the secondary cell is computed based on the charging current from the power generation means to the secondary cell and time required for the charge. The charged energy is used to sense the true electric residue of the secondary cell for outputting an electric residue detection signal.

According to the present invention, thus, the true electric residue of the secondary cell can be sensed and indicated also by sensing the energy actually charged into the secondary cell.

DETAILED DESCRIPTION OF THE PREFERRED EMBODIMENTS

The present invention will now be described in connection with an analog display type electronic wrist watch to which the principle of the present invention is applied.

First Embodiment

Figure 2:
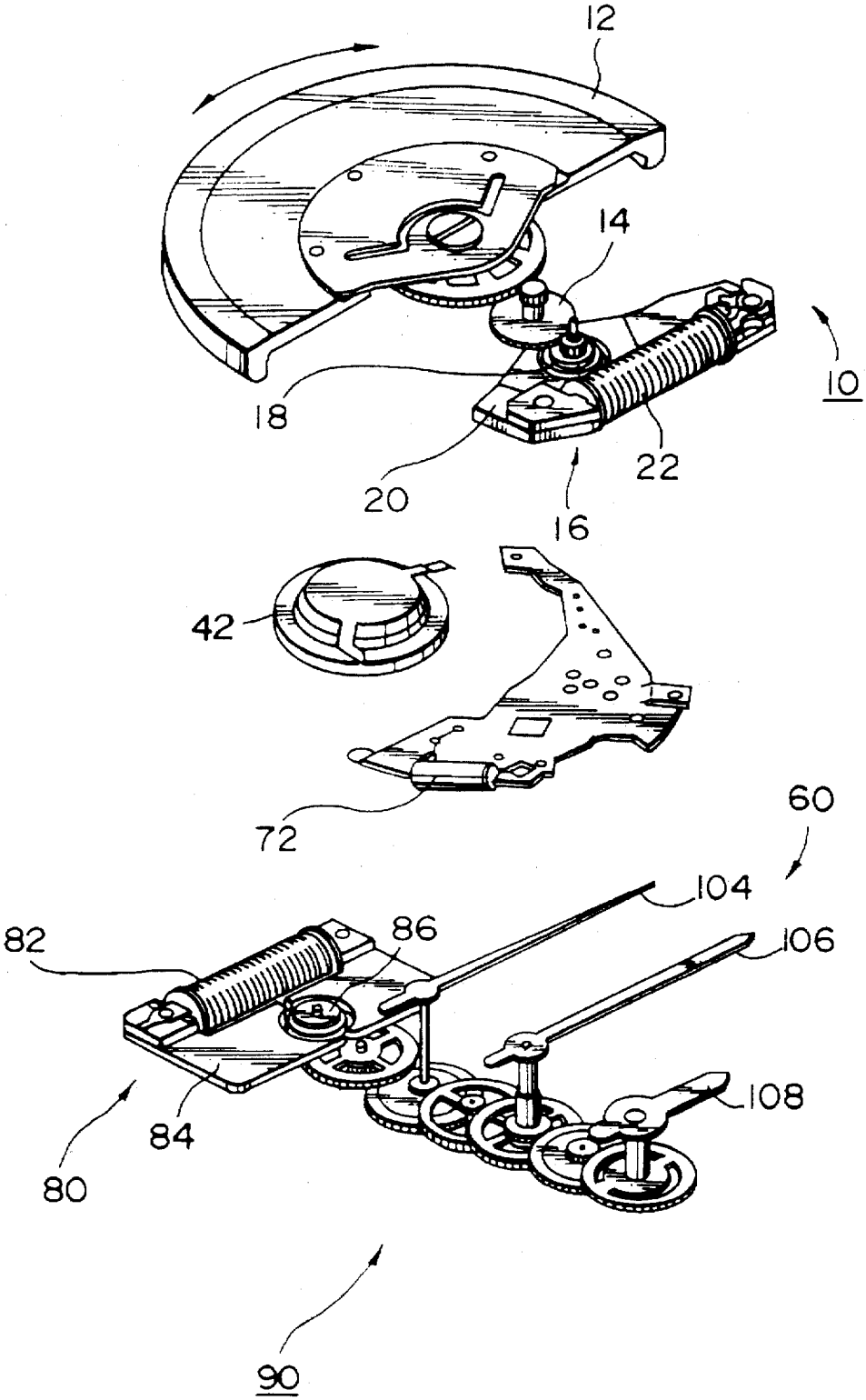
FIG. 2 is a view illustrating the primary mechanical parts of the electronic timepiece shown in FIG. 1.

FIG. 2 shows a power generation means 10 and a drive mechanism 60 of an electronic timepiece according to the first embodiment of the present invention.

The power generation means 10 comprises a semi-circular rotary weight 12 rotatably mounted in a base plate within a watch casing, a gear train mechanism 14 increasing the rotation of the rotary weight 12, and a power generator 16 including a generator rotor 18 rotatably driven through the gear train mechanism 14.

As a user moves his or her arm on which the electronic wrist watch is mounted, the rotary weight 12 is rotated to produce a kinetic energy which is a rotational motion in a direction of arrow. The rotation of the rotary weight 12 is increased about 100 times by the gear train mechanism 14 and thereafter transmitted to the generator rotor 18. The high-speed rotation of the generator rotor 18, which comprises N- and S-polar permanent magnets, changes a magnetic flux crossing a generator coil 22 through a generator stator 20.

Figure 1:
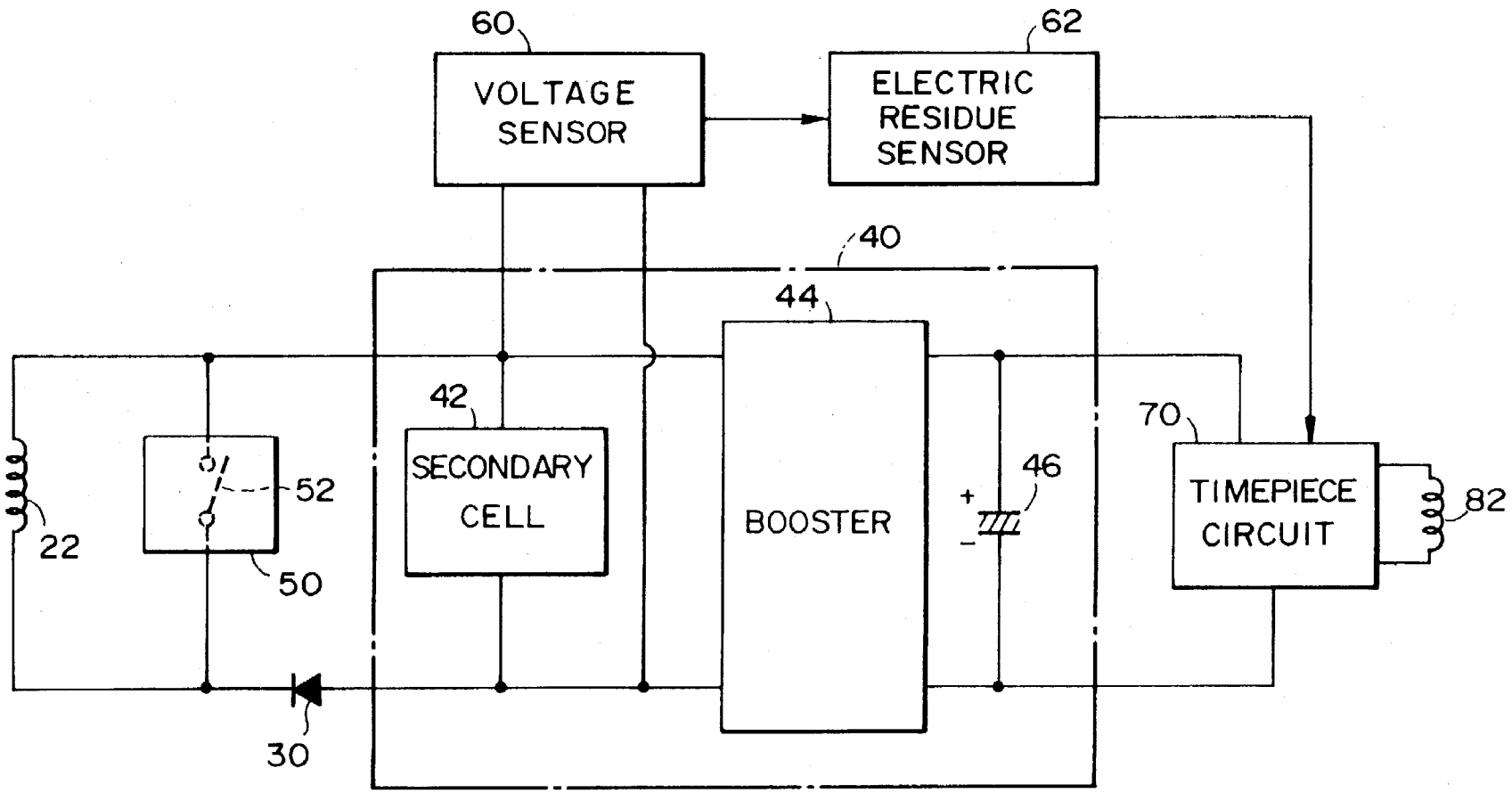
FIG. 1 is a circuit diagram of an electronic timepiece constructed in accordance with the first embodiment of the present invention.

As the magnetic flux changes, the generator coil 22 outputs AC voltage due to electromagnetic induction. The AC voltage is rectified by a rectifier diode 30 shown in FIG. 1 and then used to charge a secondary cell 42. The secondary cell 42 forms a secondary power supply 40 with a booster circuit 44 and an auxiliary capacitor 46.

When the power generator 16 is actuated as described, the secondary cell 42 is charged through the generator coil 22. In the first embodiment, the voltage of the secondary cell 42 is increased to a level high enough to drive the wrist watch by the booster circuit 44 when the voltage of the secondary cell 42 is insufficient to drive the wrist watch. The increased voltage is accumulated in the auxiliary capacitor 46. The auxiliary capacitor 46 then functions as a drive power supply for the timepiece circuit 70.

In the timepiece circuit 70, an output of an oscillator circuit including a quartz oscillator is frequency divided by a divider circuit, then, a drive circuit counts the divided frequency output. Thus, the timepiece circuit 70 outputs drive pulses of different polarities toward a drive coil 82 of a stepper motor 80 every second.

Thus, the stepper motor 80 shown in FIG. 2 rotatably drives a rotor 86 each time when it is energized by a drive pulse. The rotor 86 then drives second, minute and hour hands 104, 106, 108 through a gear train mechanism 90 to indicate the time in an analog manner.

To avoid an overcharge in the secondary cell 42, the electronic wrist watch comprises a limiter circuit 50 functioning as overcharge preventing means. The limiter circuit 50 is connected parallel to the coil 22 to form a bypass circuit for the charging circuit. The limiter circuit 50 includes a switching element 52 for turning the bypass circuit on and off. If the charged voltage of the secondary cell 22 exceeds a reference value for sensing the overcharge, the switch element 52 will be switched on. Thus, the charging current to the secondary cell 42 will flow through the bypass circuit to prevent the overcharge in the secondary cell.

Figure 3:
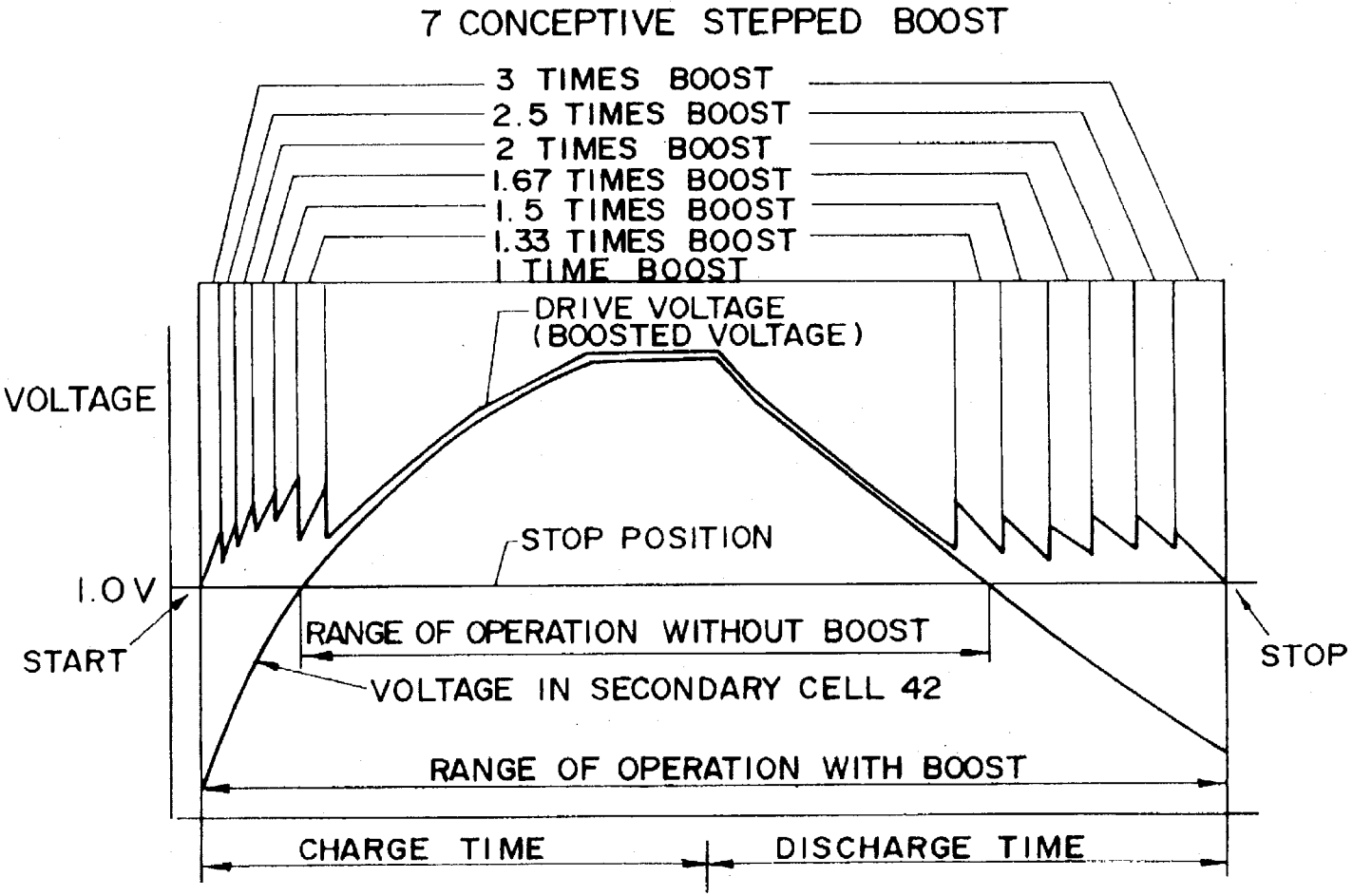
FIG. 3 is a view illustrating the operation of the booster circuit in the electronic timepiece of FIG. 1.

FIG. 3 shows a conceptive view illustrating the boosting operation in the secondary power supply 40. The minimum voltage of one volt is now required to drive the timepiece circuit 70. The secondary cell 42 accumulating the electric energy has its voltage variable depending on the charged level, unlike the conventional cells. if the charged energy lowers with the voltage being below one volt, the watch will stop because the voltage of the secondary cell becomes insufficient even if the energy itself exists. To start the watch as fast as possible and to actuate it for longer period, it is required to use the energy charged in the secondary cell 42 effectively. For such a purpose, the voltage of the secondary cell 42 is increased to a level required to drive the watch through the booster circuit 44 and then charged into the capacitor 46.

In the first embodiment, as shown in FIG. 3, the booster circuit 44 boosts the voltage of the secondary cell 42 three times through one time in seven steps as the voltage of the secondary cell 42 increases through the charge so that the auxiliary capacitor 46 is charged to have one volt or higher. Similarly, as the voltage of the secondary cell 42 attenuates due to discharge or the like, the booster circuit 44 boosts the voltage one time through three times in seven steps to charge the auxiliary capacitor 46.

In such an electronic wrist watch, it is necessary to inform the user how much longer the watch can continue its operation. For such a purpose, the electronic wrist watch of the first embodiment includes an indicator means for indicating the present charged energy of the secondary cell 42 in terms of how much longer the watch can continue its operation.

For detecting the electric residue, an electronic timepiece of the present embodiment comprises a voltage sensor unit 60 for sensing the voltage of the secondary cell 42 and an electric residue sensor unit 62 for sensing the electric residue of the secondary cell 42 from the sensed voltage to form an electric residue detection signal which is in turn outputted toward the timepiece circuit 70.

The timepiece circuit 70 is adapted to perform the rapid traverse of the second hand and to indicate the electric residue of the secondary cell 42 by the position of the rapidly traversed second hand when a button 92 located adjacent to a crown is depressed. More particularly, the second hand may be rapidly traversed by 30 seconds if the electric residue of the secondary cell 42 is for three or more days; the second hand may be rapidly traversed by 20 seconds if the electric residue is for two or more days; the second hand may be rapidly traversed by 10 seconds if the electric residue is for one or more days and the second hand may be traversed by 5 seconds if the electric residue is for 3 hours or more. In such a manner, the electric residue of the secondary cell 42 will be indicated. If the electric residue is for less than three hours, the second hand may be rapidly traversed by two seconds through any suitable mechanism.

Figure 5:
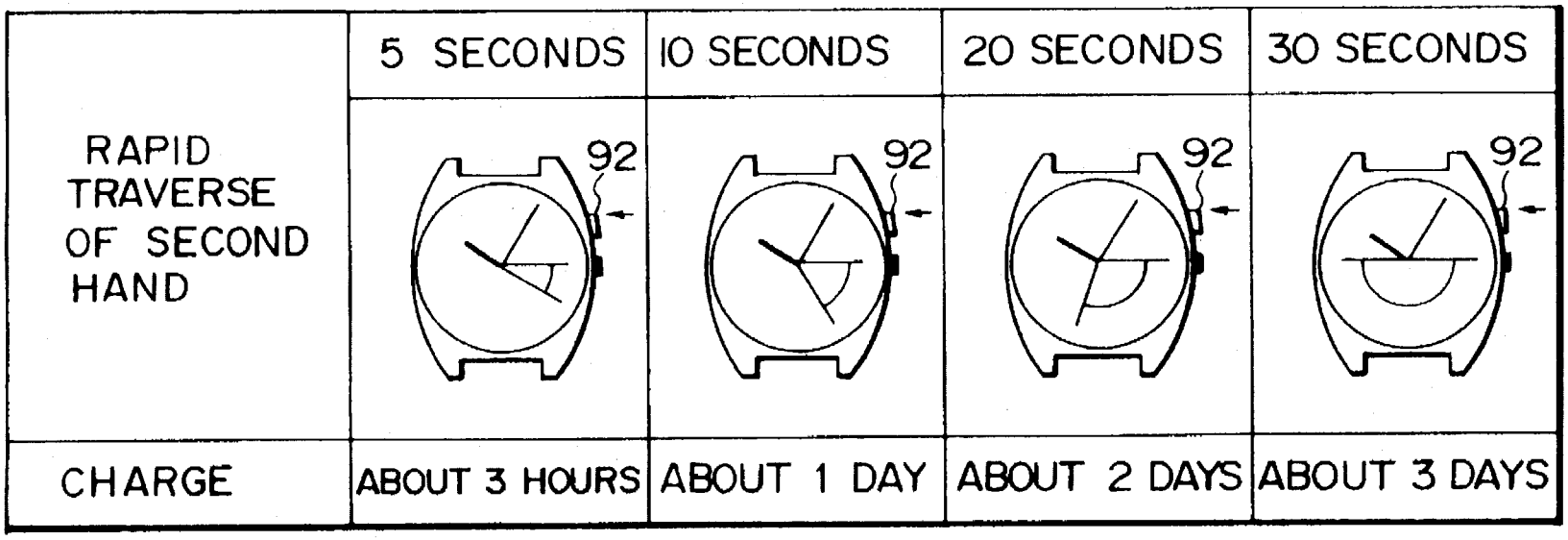
FIG. 5 illustrates examples of electric residue level indications.

If the electric residue of the secondary cell 42 decreases to an undesirable level, the user will make the rapid charge to the secondary cell 42 to charge it until a predetermined charge, e.g., a charge corresponding to one day is attained, while viewing such an indicator as shown in FIG. 5. In the electronic wrist watch of the first embodiment including such a power generation means as shown in FIG. 2, such a rapid charge is accomplished by shaking the wrist watch to rotate the rotary weight 12.

Such a detection of the electric residue in the secondary cell 42 is usually accomplished by sensing the charged voltage of the secondary cell 42 through the voltage sensor means 60. Such a process of detection has no problem when the secondary cell 42 is formed by a capacitor or the like. However, the electric residue cannot be accurately sensed when the secondary cell 42 is in the form of a cell having electrodes of conductive polymer.

Even if the secondary cell 42 is in the form of such a polymer cell, the first embodiment is characterized by that it can accurately sense the electric residue of the secondary cell 42.

Figure 4:
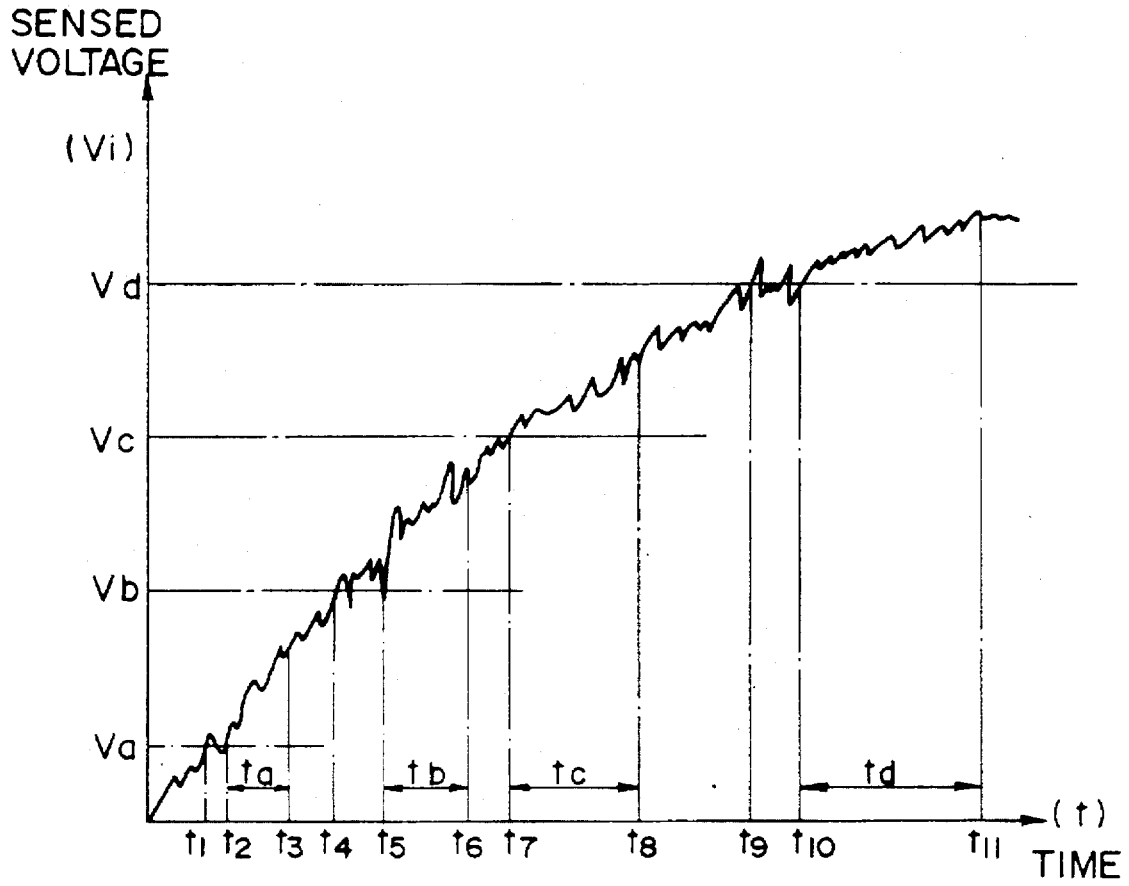
FIG. 4 is a graph illustrating the rapid charge to a secondary cell having electrodes of conductive polymer.

FIG. 4 illustrates the characteristics of rapid charge in the polymer cell 42 which is used in the first embodiment as a secondary cell. The polymer cell may be any one of various types of polymer cells which may include polyacene cell, Li/PAS cell, PAS-Li composite/PAS cell and PAS/PAS cell.

When such a type of secondary cell is rapidly charged, voltage of the secondary cell is apparently higher than the actual electric charge. As the charged energy of such secondary cell is consumed, the voltage of the secondary cell tends to sharply decline to a voltage corresponding to the true charged energy. Therefore, the terminal voltage of the secondary cell fluctuates during the rapid charge.

The electric residue sensor means 62 sets four reference voltages Va, Vb, Vc and Vd which correspond to four levels of electric residue as shown in FIG. 5(A)–5(D).

The electric residue detection of the prior art could not accurately indicate the electric residue of the secondary cell since the electric residue was indicated by judging that the desired charge had been attained at a point where the sensed voltage exceeds the reference voltages.

On the contrary, when the sensed voltage continues to exceed a reference voltage for a given time period, the electric residue sensor unit 62 judges that the secondary cell 42 has been charged to a desired level corresponding to the reference voltage and to output an electric residue detection signal.

For example, if the electric residue of the secondary cell 42 becomes substantially equal to zero and when the rapid charge is carried out, the sensed voltage Vi of the secondary cell 42 first exceeds the first reference voltage Va at a time t1, as shown in FIG. 4. Under such a condition, however, the voltage Vi immediately declines below the reference voltage Va. It is therefore judged that the charge corresponding to three hours was not made. At a time t3 whereat it is judged that the sensed voltage Vi continues to exceed the reference voltage Va for a given reference time ta, an electric residue detection signal is first outputted. Thus, the indicator will indicate the electric residue of the secondary cell when it is confirmed that a given charge was definitely carried out. As a result, the user can perform the rapid charge while trusting the indicator.

Although the same reference time may be set relative to all the reference voltages, the first embodiment sets different reference times ta, tb, to and td to the respective reference voltages Va, Vb, Vc and Vd. This makes it possible that the electric residue can be more reliably sensed depending on the charged level in the secondary cell.

Since the efficiency of charge in the polymer cell degrades as the voltage becomes higher during the charge, the reference time is preferably set longer to the higher voltage.

In the first embodiment, therefore, the reference times are set in the following manner:

ta=10 seconds;

tb=20 seconds;

tc=40 seconds; and td=60 seconds.

FIG. 4 exaggeratedly shows the principle of the present invention for illustration. The actual spacings between t3 and t4, t6 and t7 and t8 and t9 are sufficiently longer than those shown in FIG. 4.

Second Embodiment

Figure 6:
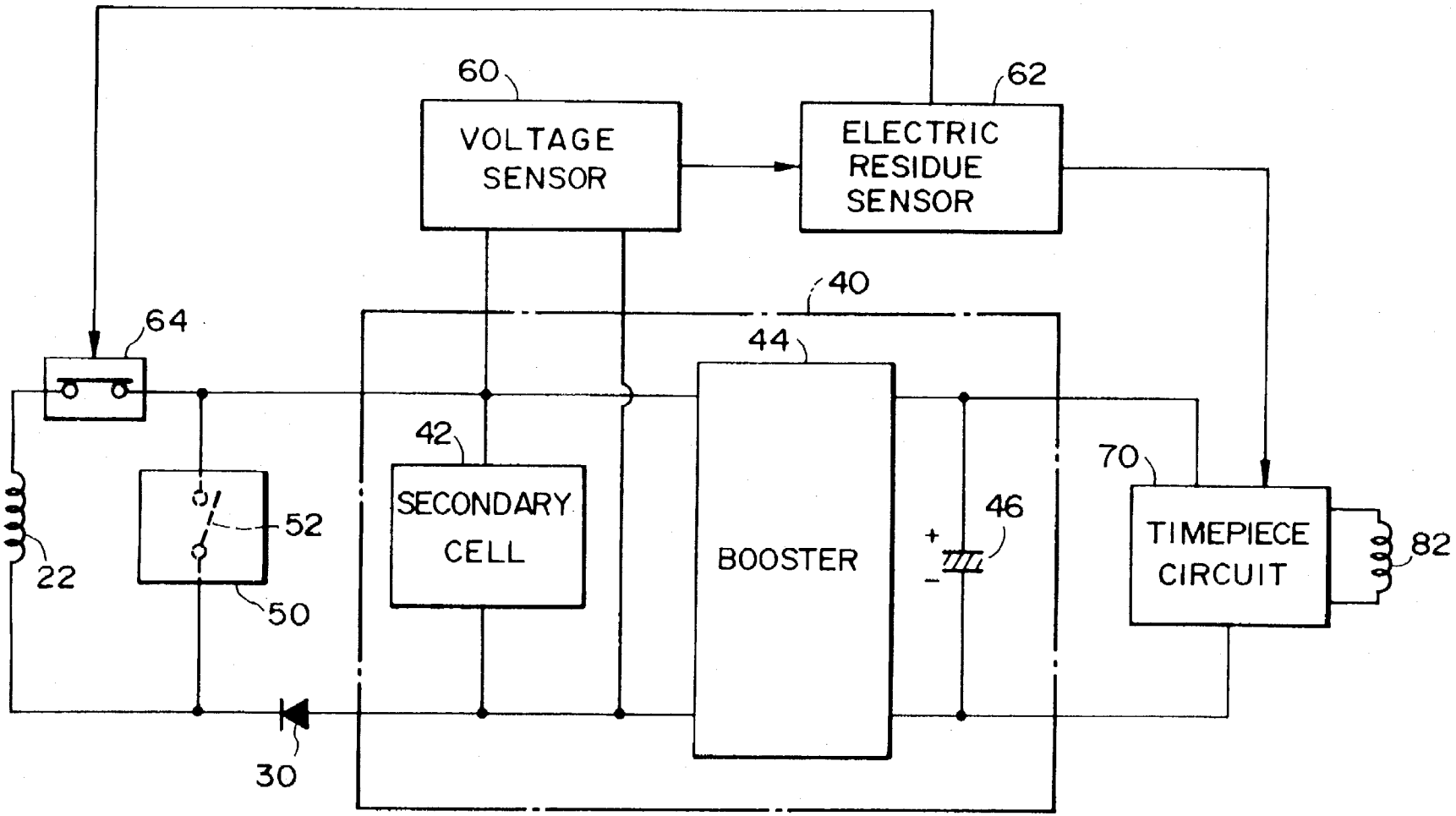
FIG. 6 is a circuit diagram of an electronic timepiece constructed in accordance with the second embodiment of the present invention.

FIG. 6 shows the second preferred embodiment of an electronic wrist watch constructed in accordance with the present invention. In this figure, parts similar to those of the first embodiment are denoted by similar reference numerals and will not further be described.

The electronic wrist watch of the second embodiment comprises a charge cut-out switch 64 disposed between the generator coil 22 and the secondary cell 42. When the electric residue of the secondary cell 42 is to be sensed, the electric residue sensor unit 62 turns the switch 64 off for only a given short time period to force the charge in the secondary cell 42 to stop.

Figure 7:
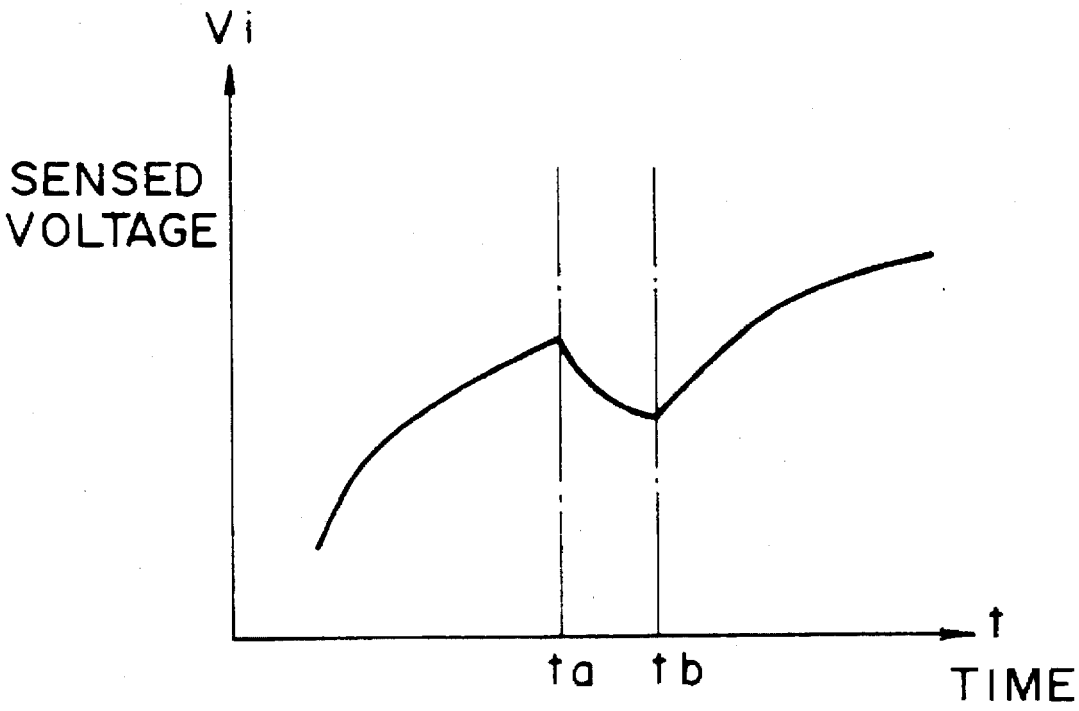
FIG. 7 is a graph schematically illustrating the principle of residue detection in the electronic timepiece shown in FIG. 6.

At this time, the voltage Vi of the secondary cell 42 sensed by the voltage sensor unit 60 varies as shown in FIG. 7. More particularly, as the switch 64 is turned off to stop the rapid charge at the time ta, the terminal voltage Vi in the secondary cell 42 initiates to attenuate toward a stable voltage corresponding to the true charge level.

From the characteristics of the polymer cell, it can be judged that the actual charge is smaller as the voltage drop is greater after passage of a given time period from the stoppage of the charge.

The electric residue sensor unit 62 estimates and computes the stable voltage of the secondary cell 42 corresponding to the charged level from such an attenuation characteristics of the secondary cell 42 and the sensed voltage Vi. The estimated and computed voltage is then compared with each of the reference voltages Va–Vd. If the estimated and computed voltage exceeds any one of the reference voltages, the electric residue detection signal corresponding to that reference voltage is outputted toward the timepiece circuit 70.

Thus, the electric residue of the polymer cell 42 can be accurately sensed during the rapid charge.

Third Embodiment

Figure 8:
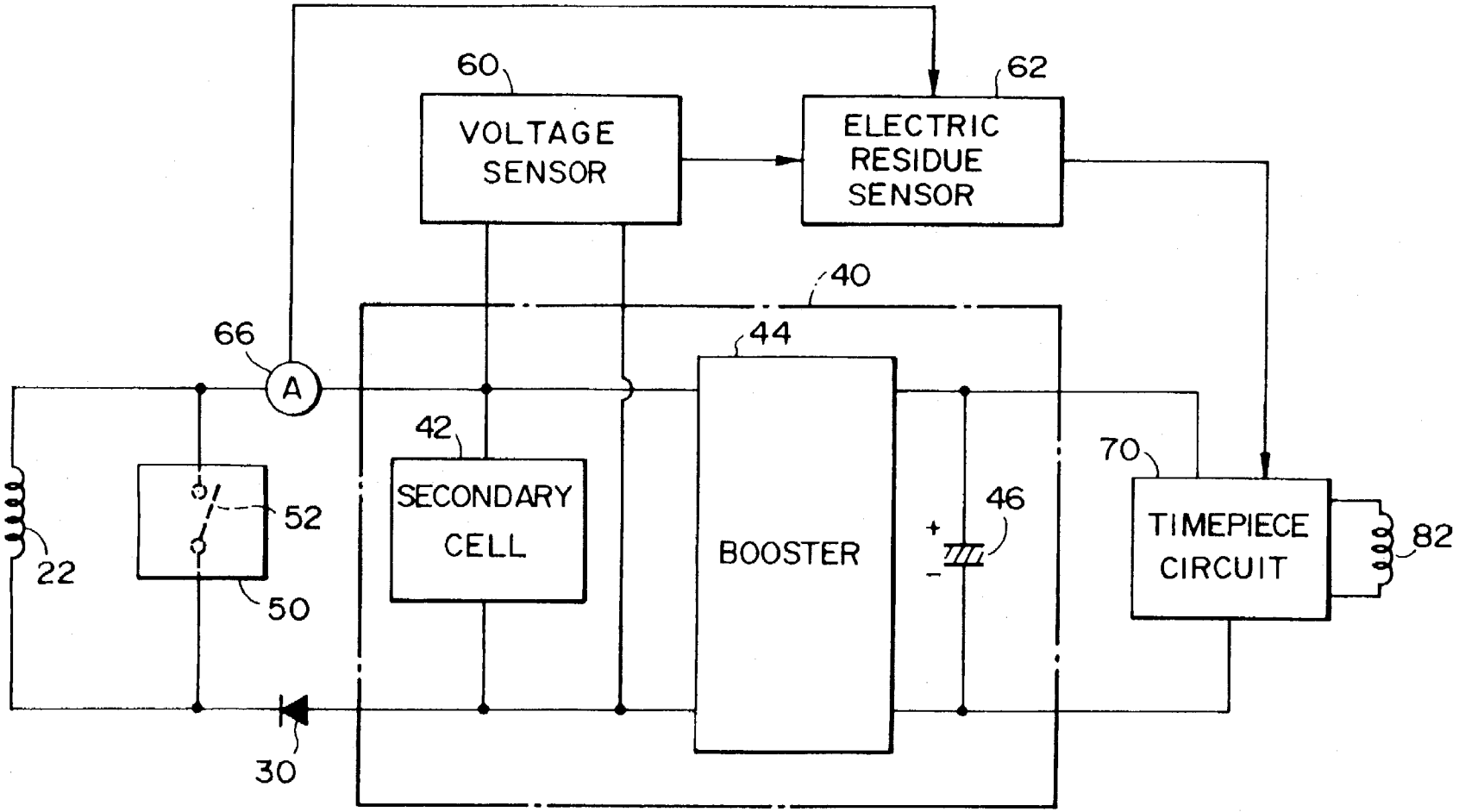
FIG. 8 is a circuit diagram of an electronic timepiece constructed in accordance with the third embodiment of the present invention.

FIG. 8 shows the third preferred embodiment of the present invention.

The electronic wrist watch of the third embodiment comprises an ampere meter 66 disposed between the generator coil 22 and the secondary cell 42. The output of the ampere meter 66 is fed to the electric residue sensor unit 62.

The electric residue sensor unit 62 computes the charged energy in the secondary cell 42 from the sensed charging current and time required to charge the secondary cell 42 to the charged level. The electric residue sensor unit 62 then corrects and computes the sensed voltage from the charged energy. The corrected voltage is then compared with each of the reference voltages Va–Vd. If the corrected voltage exceeds any one of these reference voltages, a electric residue detection signal corresponding to that reference voltage is outputted from the electric residue sensor unit 62 toward the timepiece circuit 70.

In such a manner, the electric residue sensor unit 62 of the third embodiment corrects the increment in the sensed voltage of the secondary cell 42 from the computed charged energy to estimate the voltage corresponding to the charge level. Thus, the electric residue of the polymer cell 42 can be accurately sensed during the rapid charge.

If the correlation between the charged energy and the voltage has been previously tabled and stored in the electric residue sensor unit 62, the charged energy determined by the charging current and time may be used to estimate the charged voltage without use of the voltage sensor unit 60.

The present invention is not limited to the aforementioned embodiments, but may be carried out in any one of various modified and changed forms without departing from the scope of the invention.

For example, the power generation means using the power generator 16 and the rotary weight 12 as shown in FIG. 2 may be replaced by any other suitable power generation means such as solar cell or the like.

The analog indicator using the second hand to indicate the electric residue may be replaced by a liquid crystal display.

Furthermore, the electric residue may be auditorily warned through any suitable voice output IC.

Although the embodiments have been described as to the electronic wrist watch, the present invention is not limited to this, but may be applied to any other timepiece such as pocket watch or the like.

We claim:

1. An electronic timepiece comprising:

power generation means for outputting an electric charging energy;

a secondary power supply chargeable by the electric charging energy, said secondary power supply including a secondary cell with electrodes of conductive polymer;

a timepiece circuit actuatable by a charged energy of the secondary power supply;

voltage sensor means for sensing a voltage of the secondary power supply;

electric residue sensor means responsive to the sensed voltage of the secondary power supply for sensing an electric residue of the secondary power supply, said electric residue sensor means being operative to output an electric residue detection signal corresponding to a reference voltage preset for an electric residue in the secondary cell only when said sensed voltage exceeds the reference voltage for a predetermined reference time; and electric residue warning means for warning a user in response to said electric residue detection signal, to charge the secondary power supply.

2. An electronic timepiece as defined in claim 1 wherein the electric residue sensor means is operative to output a residue detection signal corresponding to one of reference voltages preset for various levels of electric residue in the secondary cell when the sensed voltage continues to exceed said one of reference voltages for a predetermined reference time.

3. An electronic timepiece as defined in claim 2 wherein the electric residue sensor means sets said reference time for each reference voltage.

4. An electronic timepiece as defined in claim 1 wherein the secondary cell is one selected from a group consisting of polyacene cell, Li/PAS cell, PAS-Li composite/PAS cell and PAS/PAS cell.

5. An electronic timepiece as defined in claim 2 wherein the secondary cell is one selected from a group consisting of polyacene cell, Li/PAS cell, PAS-Li composite/PAS cell and PAS/PAS cell.

* * * * *